United States Patent [19]

Eriksen

[11] 4,363,351

[45] Dec. 14, 1982

[54] THERMAL INSULATING SHUTTER ASSEMBLY

[76] Inventor: George Eriksen, 201 E. Hopkins, Aspen, Colo. 81611

[21] Appl. No.: 129,018

[22] Filed: Mar. 10, 1980

[51] Int. Cl.[3] ..... E05D 15/26; E04C 1/16

[52] U.S. Cl. ..... 160/187; 160/213; 52/309.9

[58] Field of Search ..... 160/213, 210, 212, 229 R, 160/228, 187, 104, 40, 118; 52/795, 809, 309.9, 407; 428/410, 309.8; 49/483, 485, 232, 229 R

[56] References Cited

U.S. PATENT DOCUMENTS

| | | | |
|---|---|---|---|
| 1,004,336 | 9/1911 | Athey | 160/40 |
| 1,868,080 | 7/1932 | Slater et al. | 160/40 |
| 1,983,617 | 12/1934 | Ladon | 160/DIG. 7 |
| 2,923,027 | 2/1960 | Bury | 160/213 X |
| 3,363,889 | 1/1968 | Shirley et al. | 52/410 X |
| 3,413,180 | 11/1968 | Smith | 428/310 |
| 3,466,801 | 9/1969 | Bohn | 49/483 X |
| 3,667,180 | 6/1972 | Tischuk | 52/309.9 X |
| 4,265,067 | 5/1981 | Palmer | 52/309.9 |

FOREIGN PATENT DOCUMENTS

| | | | |
|---|---|---|---|
| 8786 | of 1911 | United Kingdom | 160/187 X |
| 241816 | 10/1925 | United Kingdom | 160/187 |
| 294407 | 7/1928 | United Kingdom | 52/809 |

*Primary Examiner*—Price C. Faw, Jr.
*Assistant Examiner*—Cherney S. Lieberman
*Attorney, Agent, or Firm*—John L. Isaac

[57] ABSTRACT

A shutter assembly is disclosed for the selective covering of a wall opening. The shutter assembly includes at least one set of shutter elements with each set having at least first and second shutter elements. Each shutter element includes a pair of spaced panel members and end elements interconnecting the panel members to form top and bottom ends members and oppositely disposed side members and to define an enclosed interior chamber therewithin. A member is interposed between the panel members within the interior chamber for providing thermal insulation and to define enclosed air spaces between the thermal insulating member and each of the panel members. Reflective elements are disposed on each side of the thermal insulating member for preventing thermal radiation energy loss. The shutter assembly also includes a jamb structure disposed adjacent the wall opening for mounting each set of shutter elements. Joint structures are disposed along the side members of the shutter elements and the jamb element to afford positive interengagement therebetween when the shutter elements and the jamb element are aligned with each other in a closed position to cover the wall opening. Insulation is disposed along the joint structures and the top and bottom end members of each shutter element for thermally sealing the shutter elements when in a closed position. Finally, an arrangement is included for permitting movement of the shutter elements of each set of elements away from the wall opening to an open position.

1 Claim, 6 Drawing Figures

THERMAL INSULATING SHUTTER ASSEMBLY

BACKGROUND OF THE INVENTION

1. Field of the Invention

This invention relates generally to insulating devices and more particularly to shutter assemblies for windows, doors, and the like. Specifically, the subject invention relates to an improved interior shutter construction and assembly which provides exceptional and unexpected thermal insulation properties.

2. Description of the Prior Art

Energy conservation efforts have been increasing dramatically for a number of years. Such efforts are on a national scale and are attributable to several factors. One such factor is the increasing cost of oil. Another factor is the rapid depletion of many of our non-renewable energy resources, such as oil, gas and coal. Thus, for both conservation reasons as well as economic reasons, a great deal of effort is being expended in finding means for increasing the efficiency of heating and cooling plants as well as for reducing energy consumption.

One significant area of energy consumption involves the heating and cooling of building structures, such as homes, offices, industrial plants and the like. A major source of thermal energy loss in virtually all such existing buildings are the wall openings therein such as windows, doors and patio doors. While a great deal of effort has been directed to providing more efficient wall construction and insulation for such structures, such as illustrated in U.S. Pat. Nos. 2,172,048 and 4,160,349, it is only recently that serious efforts have been made to devise more efficient insulation mechanisms for wall openings. Prior to such recent efforts, the means utilized for insulating wall openings such as windows typically consisted of interior drapes and blinds or exterior window shutters, which also doubled as fireproof doors and burglar defeating devices. Examples of such devices are illustrated in U.S. Pat. Nos. 19,348, 858,287 and 996,781. However, such structures, usually metallic, provided very little thermal insulation or energy savings.

Wall openings such as patio doors, door windows and wall windows commonly include a single pane of glass. To determine the energy efficiency of such structures, a thermal resistance value (R-value) is measured, wherein the R-value is equal to the resistance to heat flow therethrough as defined by the following equation:

$$R = \frac{\text{hr} \cdot \text{ft}^2 \cdot {}^\circ\text{F.}}{\text{Btu}} \quad (1)$$

To illustrate the exceptionally large inefficiency of such glass window openings, the thermal resistance (R-value) of a normal insulated studded wall is about 11. The same R-value measurement for a double-paned glass window, as illustrated in U.S. Pat. No. 4,160,348, is only 1.8. Thus, even with a double-pane glass wall opening, the thermal energy (heat or air conditioning) losses are six times greater than the wall structure surrounding the opening. As another example, such a thermal loss is even twice as great as the loss through an uninsulated concrete floor. Adding a third pane to such a window structure would normally increase the R-value to approximately 2.4. However, such a structure is still much less energy efficient than the insulated wall structure surrounding the opening. Moreover, double and triple glazed windows reduce solar transmission significantly, with 10–15% of the incident radiation being filtered by each pane. Thus, multiple glazing may increase the R-value somewhat for insulation purposes, but it also reduces day-time capability of solar heating through solar transmission.

The more recent efforts to provide effective insulation for wall openings have generally been directed to adding a thermal cover to such a wall opening, for use particularly during night-time hours. One such thermal cover is marketed under the trademark "Window Quilt", by Appropriate Technology, Brattleboro, Vt. This device is a foil lined quilt that rolls down over the wall opening and is air sealed on all four sides. Apparently, the foil of this quilt reflects heat, and the seals create a large airspace for insulation between the quilt and the window. Such a quilt has an R-value of approximately 5.2, and this value is a significant increase in the thermal resistance factor as compared to a double or triple pane glass window. However, this is still substantially lower than the thermal resistance of an insulated wall structure itself. Thus, even when equipped with such a quilt, a wall opening will still be a source of significant thermal energy loss.

Moreover, such fabric or curtain approaches to movable window insulation in general have been severely limited in longevity by rapid deterioration due to alternate exposure to heat and cold (direct sunlight/below zero evening temperatures) and to dryness and moisture (direct sunlight/night condensation resulting from limited sealing capability). Such factors tend to crack and shrink the fabric and therefore destroy its sealing capability as well as deteriorate the product. Finally, cleaning of such fabric coverings is awkward and costly and tends to further accelerate product deterioration.

The present invention overcomes the aforementioned problems and insufficiencies and provides an energy efficient interior shutter assembly for covering a wall opening. The assembly of the present invention is constructed so as to provide an R-value of approximately 9.1–9.5. Thus, the thermal energy efficiency and conservation provided by the present invention is significantly better than any device heretofore known.

SUMMARY OF THE INVENTION

Therefore, it is one object of the present invention to provide an assembly for thermally insulating a wall opening against interior heat and air conditioning losses.

It is a further object of the present invention to provide a foldable, interior shutter assembly for thermally insulating windows, doors and the like.

It is yet another object of the present invention to provide an improved shutter construction having high thermal resistance values when mounted to cover a wall opening.

In accordance with the invention, a shutter assembly is provided for the selective covering of a wall opening. The shutter assembly includes at least one set of shutter elements with each set having at least first and second shutter elements. Each shutter element includes a pair of spaced panel members and peripheral end elements interconnecting the edges of the panel members to form top and bottom end members and oppositely disposed side members and to define an enclosed interior chamber therewithin. An insulating structure is interposed between the panel members within the chamber for providing thermal insulation and to define enclosed air spaces between the thermal insulating structure and each of the panel members. In addition, a reflective element is disposed on each side of the thermal insulating structure to protect against thermal radiation losses.

The shutter assembly further includes a jamb element for supporting one set of the shutter elements and which is adapted for mounting adjacent the wall opening. Interlocking joint structures are provided along the side members of the shutter elements and the jamb element to afford positive interengagement therebetween when the shutter elements and jamb element of each set of elements are aligned with each other in a closed position to cover the wall opening. In addition, insulation is disposed along the interlocking joint structures and the top and bottom end members of each shutter element for thermally and mechanically sealing the shutter elements when in a closed position. Finally, a hinge arrangement is provided for permitting movement of the shutter elements of each set of elements away from the wall opening to an open position.

In one preferred form of the invention, the shutter assembly includes two sets of shutter elements with each set having a first and second shutter element. The shutter elements of each set are hinged together and to a jamb element in such a manner that all the shutter elements of both sets of elements are in coplanar alignment when in the closed position and covering the wall opening.

BRIEF DESCRIPTION OF THE DRAWINGS

The novel features which are believed to be characteristic of the present invention are set forth in the appended claims. The invention itself, however, together with further objects and attendant advantages thereof, will become apparent and best understood by reference to the following detailed description taken in connection with the accompanying drawings, setting forth by way of illustration and example certain embodiments of the invention in the several figures of which like reference numerals identify like elements, and in which:

DETAILED DESCRIPTION OF THE PREFERRED EMBODIMENTS

Figure 1:
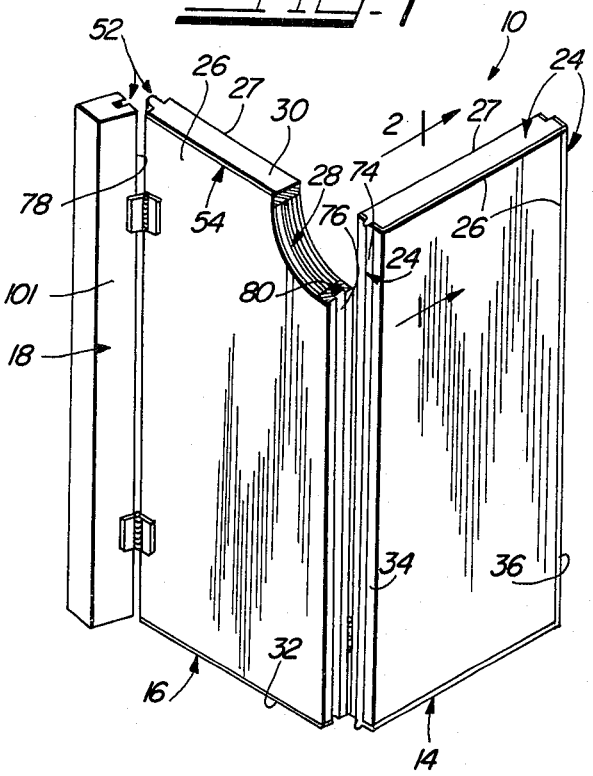
FIG. 1 is a front perspective view, with a portion cut away, of a thermal insulating shutter assembly constructed in accordance with the present invention and illustrating the shutter elements thereof in a partially closed position.
Figure 6:
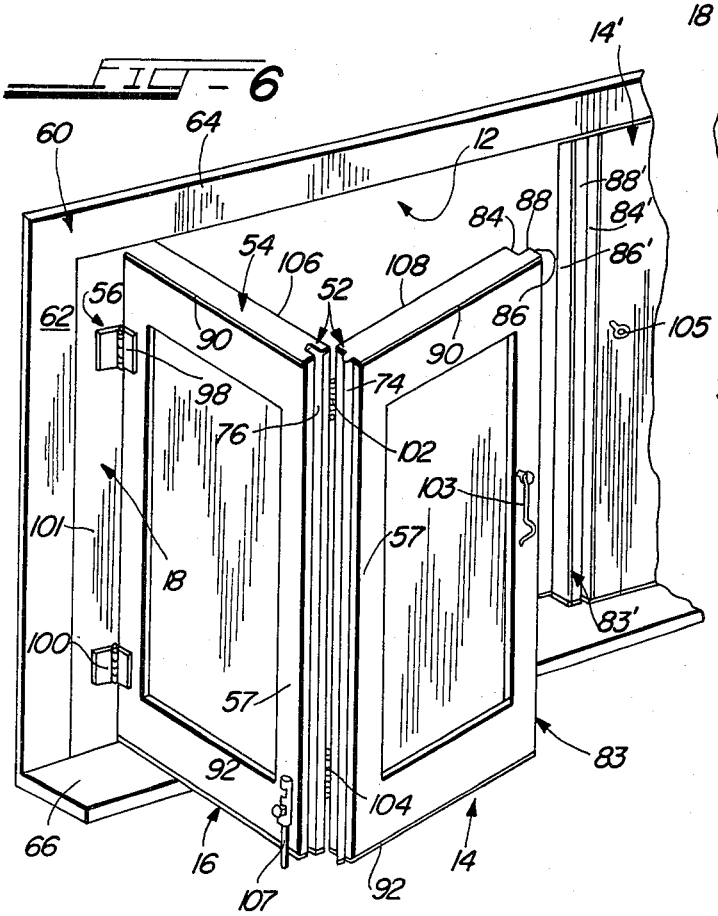
FIG. 6 is a front perspective view of the shutter assembly of the present invention mounted to a window frame and in a partially closed position.

Referring to the drawings and in particular to FIGS. 1 and 6, a thermal insulating shutter assembly 10 is provided for covering a wall opening 12 such as a wall window, a door window, a glass patio door or the like. For the purpose of explanation and illustration, a window structure 12 will generally be described below. However, it should be noted that the present invention may be utilized with any type of wall opening wherein it is desired to reduce the thermal energy loss therethrough.

In a preferred form, the thermal insulation shutter assembly 10 includes a set of shutter elements comprised of a first shutter element 14, a second shutter element 16 and a jamb element 18. While the number of shutter elements 14, 16 included in a set of shutter elements may vary from one to approximately four of such elements, it is preferred that each set be limited to two elements 14, 16. Otherwise, the weight imposed on the hinge means to be described below may become undesirably great.

Figure 2:
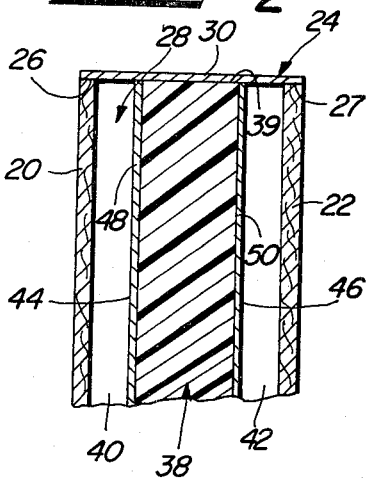
FIG. 2 is an expanded, partial cross-sectional view taken substantially along line 2—2 of FIG. 1 and illustrating the internal construction of the shutter element of the embodiment shown in FIG. 1.

Referring now to FIGS. 1 and 2, each shutter element 14, 16 includes a pair of spaced panel members 20 and 22. The peripheral end structure 24 interconnects the corresponding edges 26, 27 of the panel members 20, 22 so as to form an enclosed interior channel 28 therewithin. In a preferred form, a peripheral end structure 24 is in the form of a top end member 30, a bottom end member 32 and oppositely disposed side members 34, 36.

An insulating structure 38 is interposed between the panel members 20, 22 within the chamber 28 for providing thermal insulation. The insulating structure 38 also defines enclosed air spaces 40 and 42 between the structure 38 and the respective panel members 20, 22, the air therein remaining unrefreshed which substantially eliminates condensation therein. In preferred form, the insulating structure 38 comprises a single sheet of insulation material having its outer circumferential edges abutting the inner surfaces of the peripheral end structure 24. Each shutter element 14, 16 also includes a reflective element 44, 46 disposed on the respective outer surfaces 48, 50 of the insulating structure 38. The reflective elements 44, 46 are adapted to provide protection against thermal radiation losses.

Referring more particularly to FIGS. 1 and 6, a joint structure 52 is disposed along the side members 34, 36 of the second shutter element 16, along the side member 34 of the first shutter element 14 and along the jamb element 18. The joint structure 52 is preferably interlocking and constructed and arranged to provide positive interengagement between the first and second shutter elements 14, 16 and between the jamb element 18 and the second shutter element 16 when the shutter elements 14, 16 and the jamb element 18 of each set of elements are in coplanar alignment with each other to define the closed position, and are thereby covering the wall opening 12. A layer of insulation 54 is disposed along the interlocking joint structures 52 and the top and bottom end members 30, 32, respectively, of each of the shutter elements 14, 16. The thermal insulation layers 54 are provided for thermally sealing the shutter elements 14, 16 when the shutter assembly 10 is in its closed position across the window opening 12.

Finally, the shutter assembly 10 also includes a hinging arrangement 56 which permits movement of the shutter elements 14, 16 of each set of elements away from the wall opening 12 from its closed position to an open position. In this open position, the second shutter element 16 is disposed immediately against the jamb element 18 and the wall member 58 which defines the wall opening 12, and the first shutter element 14 is disposed substantially congruently with the second shutter element 16. This hinging arrangement 56 therefore provides a stacked arrangement of the shutter elements 14 and 16 against the wall 58 immediately adjacent the opening 12.

Referring once again to FIGS. 1 and 2, the spaced panel members 20, 22 are preferably substantially rectangular in form and are aligned substantially parallel to each other. In the preferred form, the panel members 20, 22 are sized so that the edges 26,27 thereof are congruous. The panel members 20, 22 may be constructed from any desirable solid material. However, it is preferred that the panel members 20, 22 be constructed from a low density material having a high insulation value and a relatively light weight. Otherwise, the cumulative weight of the shutter elements 20, 22 may cause sagging of the hinge arrangement 56 at the jamb element 18. The panel members 20, 22 should also be very stable relative to temperature differentials on either side thereof to prevent warpage. In the preferred form, the panel members 20, 22 are constructed from northern basswood, which material exhibits all of the qualities identified above. In addition, basswood has tended to maintain a relatively stable price over the years due to minimum industrial use. Therefore, it is a very highly desirable material for the construction of the panel members 20, 22 which preferably are $1\frac{3}{8}$ inch in thickness. Other possible materials of construction include sugar pine, aluminum and other metal extrusion materials. However, these materials either have a higher density than basswood or their cost is substantially greater than basswood. Furthermore, many non-wooden materials have a further disadvantage of requiring a large amount of energy to make, thereby obviating some of the energy conservation advantages of the present invention. Finally, non-wooden materials are generally constructed from resources which are limited, whereas wood is a renewable resource.

The panel members 20, 22 may be covered in their entirety by an additional layer (not illustrated) or partially covered as illustrated at 57. This additional layer preferably comprises plywood, although fire-resistant materials such as Masonite, enamelled metal sheet, or the like can be used to reduce potential fire hazard if necessary. The plywood may be used to provide whatever design and/or finish one desires on the surface of panel members 20, 22. In addition, the peripheral end structure 24, which includes the top and bottom end members 30, 32 and the opposite side members 34, 36 are also preferably constructed from basswood. In the preferred embodiment, these members 30–36 are substantially equal in width to interconnect the substantially congruous edges 26, 27 of the panel members 20, 22.

The centrally disposed insulating structure 38 preferably is in a form of a planar core sheet. The insulation core 38 may be constructed from any number of known insulation materials, including known fire-retardant or fire-proof materials. Preferably, the core member 38 is comprised of a sheet of polyurethane approximately $\frac{3}{4}$ inch in thickness. The polyurethane exhibits desirable insulation properties yet is relatively lightweight, and the preferred polyurethane is a high density polyurethane available from Norton Products, New York, No. V728.

The reflective elements 44, 46 preferably comprise a layer of metal foil affixed to the outer surfaces 48, 50 of the polyurethane core 38. The foil is approximately 0.32 inch in thickness. The dead airspaces 40, 42 defined between the metal foil 44, 46 and the panel members 20, 22, respectively, are preferably about 1/16 inch–$\frac{1}{4}$ inch in width. At least 1/16 inch is preferred to insure separation of the foil 44,46 from the panel members 20, 22, and more than about $\frac{1}{4}$ inch will create undesirable convection currents therein.

The insulation core 38 is particularly adapted to prevent thermal energy loss therethrough by infiltration and conduction, while the reflective elements 44, 46 are particularly adapted to prevent thermal energy loss due to radiation. The dead air spaces 40, 42 are highly desirable and substantially reduce thermal energy loss due to a decrease in convection. The dead air spaces 40, 42 are sized and shaped as given above so as to minimize and virtually eliminate convection currents therein, yet these air spaces provide substantial insulation in the form of non-conduction. It should be noted that one of the major problems with the prior art double and triple pane window designs is that the spacing between the glass panes is so large as to permit the formation of large convection currents therewithin. These convection currents thereby allow large heat transfers to occur through conduction and radiation. Thus, such designs partially defeat the purpose of creating a dead air space. The dual dead air space design of the shutter element of the present invention, however, is arranged such that convection currents therein are virtually non-existent. Therefore, thermal energy transfer is decreased significantly through the reduction of convection, radiation and conduction factors as described in greater detail below.

Referring again to FIGS. 1 and 6, the shutter assembly 10 is preferably sized and shaped to fit within a casing structure 60 which defines the wall opening 12. The casing 60 is generally a frame structure which is secured to the wall 58. The casing 60 preferably has a pair of vertical members 62, a horizontal top member 64 and a lower window sill 66. This particular construction, however, will vary a great deal depending on whether the wall opening is a wall window, a door window, a patio door or the like. As described below, the shutter assembly 10 of the present invention can be adapted to be attached to any number of different interior casing arrangements.

Referring to FIGS. 1 and 3–6, the jamb element 18 is adapted to be affixed to one of the vertical casing members 62. In one form of the invention illustrated in FIG. 3, the inward disposed edge portion 68 of the vertical casing member 62 projects inwardly, beyond the inner surface 70 of the wall 58. In this particular embodiment, the jamb element 18 includes a longitudinal recess 72 sized and shaped to receive the projecting end portion 68 in such a manner that the remaining portion of jamb element 18 lies immediately adjacent the inner surface 70 of the wall member 58.

Figure 4:
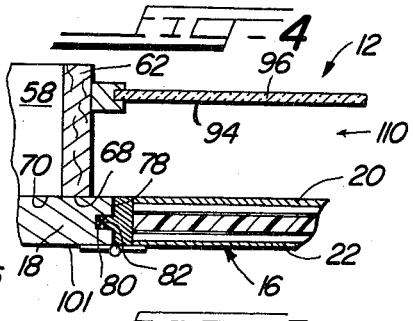
FIG. 4 is a partial, cross-sectional schematic view similar to FIG. 3, but illustrating a second embodiment of the jamb structure of the invention for mounting to a window casing.

In another embodiment of the present invention illustrated in FIG. 4, the inward edge portion 68 of the vertical casing member 62 is aligned flush with the inner surface 70 of the wall member 58. In this particular instance, the jamb member 18 may then be mounted flush against the edge portion 68 and the wall surface 70.

Figure 5:
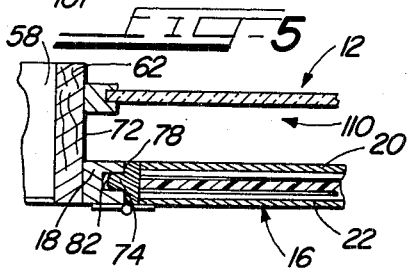
FIG. 5 is partial, cross-sectional schematic view similar to FIGS. 3 and 4 but illustrating yet a third embodiment of the jamb structure of the invention for mounting to a window casing.

Referring to FIG. 5, the arrangement between the wall member 58 and the vertical casing member 62 is the same as that illustrated in FIG. 4. However, in this embodiment, the jamb element 18 is adapted to be mounted on the interior face 72 of the vertical casing member 62, the interior face 72 facing the oppositely disposed vertical casing member 62 (not illustrated). In this manner, the jamb element 18 is mounted inside the casing 60. Any one of the above described mounting techniques may be utilized depending upon the size, shape and configuration of the wall opening casing 60.

Referring to FIGS. 1, 5 and 6, the interlocking joint structure 52 is preferably a tongue and groove arrangement. While any interlocking joint arrangement may be selected wherein the joint members intermesh and positively interengage, the tongue and groove arrangement described below is preferred. In preferred form, an elongated tongue member 74 projects outwardly from the side member 34 of each shutter element 14, 16. The tongue member 74 is preferably centrally aligned along the length of the side member 34. An elongated channel or groove 76 is positioned along the length of the side member 36 of the second shutter element 16 and is sized and shaped so as to receive the tongue member 74 of the shutter element 14 when the shutter assembly 10 is in its closed position. In addition, an elongated channel 76 is also disposed along the length of the interior face 78 of the jamb element 18 and is adapted for receiving the tongue member 74 disposed on the side member 34 of the second shutter element 16. Each channel 76 includes a layer of insulating material 80 disposed along the bottom portion thereof. The insulating material 80 is preferably high density polyurethane and is preferably at least ¼ inch thick, although any suitable durable insulation material may be used. The insulation material 80 is adapted to both thermally and mechanically seal the joint assembly 52 when the shutter assembly 10 is in its closed position. The insulation layer 80 achieves this sealing function by being compressed by and flowing slightly around the end portion 82 of the tongue member 74 when it is disposed within the channel 76. Thus, the interlocking joint structure 52 provides a very tight mechanical and thermal seal for the shutter assembly 10 when it is in its closed position, thereby preventing thermal losses due to infiltration.

The side member 36 of the first shutter element 14 is a free end in that it is not hingedly connected to any structure. Thus, the joint structure formed along the side member 36 may be an interlocking joint structure 52, or it may be lap joint structure 83 as illustrated in FIGS. 1 and 6. Referring to these figures, the side member 36 of element 14 includes a pair of stepped surfaces 84 and 86 separated by surface 88 which is perpendicular thereto. This arrangement provides a notched surface along the side member 36. The first shutter element 14' of the opposing set of shutter elements likewise includes a pair of stepped surfaces 86' and 84' separated by a perpendicular surface 88'. When the assembly 10 is in its closed position so that both sets of shutter elements are closed, the lap joint 83 of the first shutter element 14 interengages with the lap joint 83' of the first shutter element 14' so that the notched surface 84 abuts the outer surface 86' and the outer surface 86 abuts the notched surface 84'. These surfaces 84, 86, 88, 84', 86' and 88' also preferably include layers of insulation material, preferably high density polyurethane, disposed therealong. This material provides a tight mechanical and thermal seal between the lap joints 83 and 83' when the shutter assembly 10 is in its closed position.

Referring to FIGS. 1 and 6, the top and bottom end members 30 and 32 of each shutter element 14, 16 preferably include a layer of insulation material 90 and 92, respectively, disposed thereon. The layers of insulation material 90, 92 are preferably made from high density polyurethane and are approximately ½ inch wide and ¼ inch in thickness. The insulation layers 90, 92 provide tight thermal seals with, respectively, the upper casing member 64 and the window sill 66 when the shutter assembly 10 is in its closed position. This tight thermal seal eliminates air infiltration, and it also prevents contact of the interior room air with the interior surface 94 of the window pane 96. This prevention of contact with the window surface 94 aids in reducing thermal energy loss by conduction.

It should be noted that additional jamb elements similar to jamb element 18 can be provided in place of casing member 64 and window sill 66 as a part of the assembly 10. In this instance, such additional jamb elements (not illustrated) would be mounted to the casing member 64 and the window sill 66.

Referring to FIGS. 1 and 3–6, each hinging assembly 56 in preferred form includes a pair of hinges 98 and 100. In the illustrated embodiment, a first pair of hinges 98, 100 are secured to the inwardly disposed surface 101 on the jamb element 18 and the respective inwardly disposed surface 57 of the second shutter element 16. In this manner, when the second shutter element 16 is moved to its open position, the second shutter element 16 hingedly rotates about hinges 98 and 100 relative to the jamb element 18 to a position immediately adjacent the jamb element 18 and the wall 58. A second pair of hinges 102 and 104 preferably interconnect the exterior surface 106 of the second shutter element 16 and the exterior surface 108 of the first shutter element 14. In this manner, the first shutter element 14 is adapted to hingedly rotate relative to the second shutter element 16 in such a manner so that the first shutter element 14 folds against and is congruently aligned with the exterior surface 106 of the second shutter element 16 when it is in its open position. In this manner, the hinging assembly 56 permits movement of the shutter assembly 10 away from the window 12 and stacking of the shutter elements 14 and 16 against each other immediately adjacent the jamb element 18 and the wall 58 in the open position. As can be seen from this arrangement, a substantial portion of the weight of the shutter elements 14 and 16 is supported by the hinges 98 and 100. Therefore, as previously described, it is desirable to use materials of construction for the shutter assembly 10 which are generally relatively light weight, yet which provide high insulation value and are stable against temperature differentials between the interior and exterior surfaces thereof. Furthermore, latch 103, catch 105 and dead bolt 107 are used to secure the assembly 10 in its closed position.

Figure 3:
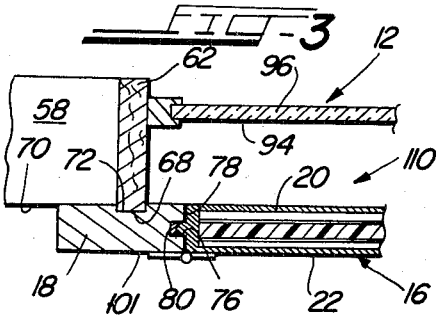
FIG. 3 is a partial cross-sectional schematic view of one shutter element and jamb structure of the present invention mounted to a window casing and illustrating the shutter assembly in a closed position and the relationship between the shutter assembly and window structure.

As described above, the purpose of the subject invention is to provide insulation against thermal energy loss through wall openings. Referring to FIGS. 3–5, when such wall openings are in the form of a window or any other structure having a glass pane 96 therein, thermal energy loss (i.e., heat loss in the winter and air conditioning loss in the summer) occurs as a result of four main factors. These factors are conduction, convection, radiation and infiltration. As can be seen from FIGS. 3 to 5 and as partially described above, several dead air spaces are created by the combination construction of the present invention. The dead air spaces 40 and 42 within the shutter elements 14 and 16 themselves inhibit thermal energy loss through reduced convection and conduction as described above. As can be seen from the arrangement of the shutter assembly of the present invention relative to a window pane 96, a large dead air space 110 is created between the pane 96 and the shutter elements 14 and 16 when the shutter assembly 10 is in its closed position. Due to the effective thermal sealing of the shutter assembly 10, the dead air space 110 also reduces thermal energy loss. However, as described above relative to the prior art double window pane systems, convection currents can be created within the space 110. Nonetheless, the dead air space 110 does contribute to the total overall efficiency of the present invention by substantially reducing condensation due to lack of recirculating and refreshing the air disposed therewithin.

The thermal efficiency of the present invention is exceptionally good and can be attributed to a number of factors, as described above, all working in combination to achieve an efficiency greater than expected from the sum of the separate factors. As a result, it has been determined that the shutter assembly 10 of the present invention provides an R-value of about 9.1–9.5. Calculations and tests of such shutters have been made and are briefly discussed below. These tests were made utilizing a prototype shutter assembly similar to that described in FIG. 1 but lacking the one dead air space 42 and the one reflective surface 46. When shutter assemblies 10 are constructed in accordance with FIG. 1 by including the additional dead air space and reflective surface, the thermal efficiency is even greater than that of the shutter actually tested which had an R-value of approximately 9.2. Therefore, the difference in R-values between that of the present invention and that of a glass window means that the shutter of the present invention saves greater than 85% of the normal heat loss of a single-glazed window. For a standard size window, this means a potential conduction savings of about 9.67 Btu/ft$^2$ Degree-Day. The convection analysis of the tested shutter assembly resulted in a total potential savings of 20.40 Btu/ft$^2$ Degree-Day.

Radiation is another heat transfer mechanism which is somewhat difficult to determine for practical situations. In the tested structure, the effects of the ceiling, floor and walls at 70° F. in radiating out of windows at 0° were taken into consideration. The result amounted to a substantial Degree-Day heat savings which are included in the above value for conduction. In addition, an infiltration analysis was made and was based on numerous assumptions, as required by the ASHRAE standards for heat loss analysis. Some of the basic assumptions were that the existing windows were single glazed, non-weather stripped on two sides of a room and were of "average" fit. Furthermore, the room in question had plastered walls (negligible infiltration through walls), and exists under average conditions for residences, exclusive of ventilation. The result of this analysis was that the tested structure provided an infiltration savings of 33.30 Btu/ft$^2$ Degree-Day.

Finally, there is a somewhat subjective yet substantial savings as a result of sensory effects. This is a description of the potential savings due to the ability of lowering the interior ambient air temperature of a room while maintaining the comfort in the room. This is achieved by raising the temperature of the surrounding surfaces, since the sensory temperature is a function based 60% on the surrounding temperature surfaces and only 40% on the actual air temperature. In this analysis, it was determined what the effective temperature is and, changing only the surface temperature of the window due to the addition of the insulating shutter assembly, the required ambient air temperature was determined in order to maintain the equivalent comfort level. The analysis was based on a 300 ft$^2$ room with 8' ceilings and 50 ft$^2$ of single-glased window. The outside temperature was equivalent to 0° F., the inside temperature was 70° F., the floor and wall temperature was 65° F., the ceiling and shutter assembly temperature was 70° F. and the glass temperature equaled the outside temperature. The result was a total savings due to sensory effects of 3.43 Btu/ft$^2$ Degree-Day.

The total thermal energy savings as a result of the present invention amounted to about 66.80 Btu/ft$^2$ Degree-Day. To determine the yearly potential energy savings, this factor of 66.80 is multiplied times the number of the average yearly Degree/Days for a particular location in the country and then times the square footage of single-glazing windows covered by the instant invention. For example, Denver, Colo. has approximately 6000 Degree-Days per year. If 100 ft$^2$ of window pane or glazing is present within a building structure, the potential savings becomes 66.80 times 6000 times 100 which results in 40.08 MBtu/year. The energy savings can then be converted to cash savings if the fuel cost is known, as well as the estimated heat content of the indicated fuel. Again, for example, for No. 2 fuel oil at $1.10 per gal. with a heat content of 140,000 Btu/gal. and for 250 ft$^2$ of single-glazed windows and 6000 Degree-Days per year, the estimated cash savings would equal $314.90 for the first year. This is also a savings of 286 gallons of fuel oil. Thus, not only is a limited fuel source conserved, but there are substantial monitary savings involved. For larger structures with substantially greater window-surface area than the above described examples, the savings is very substantial.

As can be seen from the above, the shutter construction and shutter assembly arrangement of the present invention effectively blocks heat and air conditioning losses through wall openings of a home or office. This reduction in heat and air conditioning loss represents a major contribution to reducing fuel bills and enhancing living comfort. The combination construction and arrangement of the present invention provides very effective thermal energy conservation and efficiency and eliminates more than 85% of the heat loss or air conditioning loss occuring through a typical single-pane wall opening. This results in a substantially reduced energy consumption, a substantial monetary savings and a substantial increase in the efficiency of energy usage.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein but may be modified within the scope of the appended claims.

I claim:

1. A thermal insulating shutter assembly for selective covering of the interior of a wall opening, said assembly comprising:

at least one set of shutter elements, each said set including first and second shutter elements;

each said shutter element comprising a pair of spaced, substantially parallel panel members having congruent end edges, peripheral end means interconnecting the end edges of said panel members to form top and bottom end members interconnected by oppositely disposed side members and to define an enclosed interior chamber therewithin, core means centrally disposed between and spaced from said panel members within said chamber and bounded on all sides by said peripheral end means for providing thermal insulation and to define an enclosed, dead air space between said core means and each said panel member, said core means and panel members being formed so as to define the size and shape of said dead air spaces to prevent convection currents from forming therewithin and being sufficiently sealed to substantially prevent condensation within said dead air spaces, and thermal reflective means disposed on the outer surfaces of said core means for substantially preventing thermal radiant energy loss, said reflective means being spaced from and facing the inner surfaces of said panel members;

a shutter jamb element for supporting said set of shutter elements and adapted for mounting adjacent said wall opening;

elongated tongue means disposed along the length of one side member of each said shutter element;

channel means disposed along the length of said jamb element and along the length of the other side member of said second shutter element for receiving the tongue means of said second and first shutter elements, respectively, when said shutter assembly is in a closed position wherein said jamb element and said shutter elements of said set of elements are in substantially co-planar alignment and covering said wall opening, said channel means including a layer of insulation along the bottom thereof adapted to be compressed by and flow around said tongue member when engaged within said channel means to provide firm mechanical and thermal sealing of said assembly when in said closed position;

first hinge means interconnecting said jamb element and said second shutter element to permit pivotal movement of said second shutter movement relative to said jamb element between said closed position and an open position wherein said second shutter element is disposed adjacent the inner face of said jamb element substantially parallel to said wall;

second hinge means interconnecting said first and second shutter elements to permit pivotal movement of said first shutter element relative to said second shutter element between said closed position and said open position wherein said first shutter element is disposed adjacent and congruent with said second shutter element;

lap joint means disposed along the length of the other side member of said first shutter element for sealing and locking said first shutter element in said closed position; and a layer of insulation disposed along said top and bottom end members of each said shutter element to provide thermal sealing in said closed position, said insulation creating in conjunction with said tongue and channel means insulation an enclosed, substantially sealed air space between said shutter assembly and said window to reduce thermal energy conduction losses.

* * * * *